US008076047B2

(12) United States Patent
Fukushima et al.

(10) Patent No.: US 8,076,047 B2
(45) Date of Patent: Dec. 13, 2011

(54) ELECTROPHOTOGRAPHIC PHOTORECEPTOR AND IMAGE FORMATION DEVICE PROVIDED WITH THE SAME

(75) Inventors: Kotaro Fukushima, Kawanishi (JP); Kohichi Toriyama, Yao (JP)

(73) Assignee: Sharp Kabushiki Kaisha, Osaka (JP)

( * ) Notice: Subject to any disclaimer, the term of this patent is extended or adjusted under 35 U.S.C. 154(b) by 481 days.

(21) Appl. No.: 12/408,978

(22) Filed: Mar. 23, 2009

(65) Prior Publication Data

US 2009/0245868 A1 Oct. 1, 2009

(30) Foreign Application Priority Data

Mar. 28, 2008 (JP) ..... 2008-086679

(51) Int. Cl.
*G03G 5/05* (2006.01)

(52) U.S. Cl. ..... 430/59.5; 430/59.1; 430/59.4; 430/58.05

(58) Field of Classification Search ..... 430/58.05, 430/58.1, 59.1, 59.4, 59.5, 78; 399/159
See application file for complete search history.

(56) References Cited

U.S. PATENT DOCUMENTS 5,895,739 A * 4/1999 Levin et al. ..... 430/78
6,190,811 B1 2/2001 Tanaka et al.
6,210,847 B1 * 4/2001 Miyauchi et al. ..... 430/58.4
2002/0051921 A1 5/2002 Morita et al.
2002/0057927 A1 5/2002 Kobayashi et al.
2007/0059617 A1 * 3/2007 Toda et al. ..... 430/58.05
2007/0059619 A1 * 3/2007 Shimoyama et al. ..... 430/58.7
2008/0026310 A1 * 1/2008 Kuboshima et al. ..... 430/78
2008/0031653 A1 2/2008 Niimi
2008/0286008 A1 * 11/2008 Niimi ..... 399/159

FOREIGN PATENT DOCUMENTS

CN 1346076 A 4/2002
JP 05-249708 9/1993
JP 06-175380 6/1994
JP 09-240051 9/1997
JP 2000-047408 2/2000
JP 2000-105479 4/2000
JP 2000-122319 4/2000
JP 2000-250239 9/2000
JP 2001-312081 A 11/2001
JP 2001-312081 A 11/2001
JP 2002-72519 A 3/2002
JP 2007-57657 A 3/2007
JP 2007-233347 9/2007

* cited by examiner

*Primary Examiner* — Mark F Huff
*Assistant Examiner* — Stewart Fraser
(74) *Attorney, Agent, or Firm* — Nixon & Vanderhye, PC

(57) ABSTRACT

An electrophotographic photoreceptor comprising at least a photosensitive layer formed by laminating a charge generation layer containing a charge generation material and a charge transport layer containing a charge transport material in this order, on a conductive support, wherein the charge generation layer contains an oxotitanylphthalocyanine as the charge generation material and metal oxide microparticles, and the electrophotographic photoreceptor has photosensitive properties in light source of wavelength range from 360 to 420 nm.

10 Claims, 2 Drawing Sheets

ELECTROPHOTOGRAPHIC PHOTORECEPTOR AND IMAGE FORMATION DEVICE PROVIDED WITH THE SAME

CROSS-REFERENCE TO RELATED APPLICATIONS

This application is related to Japanese Patent Application No. 200886679 filed on Mar. 28, 2008 whose priority is claimed under 35 USC §119, the disclosure of which is incorporated by reference in its entirety.

BACKGROUND OF THE INVENTION

1. Field of the Invention

The present invention relates to an electrophotographic photoreceptor (hereinafter also referred to as a "photoreceptor"), which is used for image formation in the electrophotographic system and can be exposed to short-wavelength light, and to an image formation device provided with the photoreceptor.

2. Description of the Related Art

An electrophotographic system image formation device (hereinafter also referred to as an "electrophotographic device") using electrophotographic technologies to form an image bears the responsibility of a part of high-speed information processing system devices and has made significant progress in recent years. Among these system devices, the electrophotographic system using light as the recording probe has been significantly improved in the qualities of print outputs and in reliability along with improvement in the qualities of a light source itself. Accordingly, these technologies promote not only evolution of usual printer outputs but also evolution of copy machines, so that the importance of these technologies are increased, and therefore, a growing and successive demand for these technologies are expected also in the future.

The developments of high quality printers and copy machines including those giving high-quality color images are currently awaited with full anticipation. Then, examples of the trend of technologies in the attainment of this purpose include technologies for "light sources (exposure light beam) more reduced in diameter and formations of a more highly precise latent image and a more highly developed image" and technologies for "stabilization of a photoreceptor capable of coping with the above anticipation".

To attain reduction in the size of an exposure light beam, which is the former requirement, the use of shorter wavelengths is effective. In the case of using a short-wavelength laser (LED) having, for example, a center oscillation wavelength which is nearly one-half that of the near-infrared laser (LD) as the writing light source, the spot diameter of the laser beam on the photoreceptor can be considerably reduced in theory as shown by the following equation.

$$d \propto (\pi/4)(\lambda f/D) \quad \text{(A)}$$

wherein d is a spot diameter on the photoreceptor, $\lambda$ is a wavelength of laser light, f is a focal distance of a fθ lens and D is a diameter of the lens.

Therefore, reduction in the size of the exposure beam is very advantaged in working to improve a writing density of a latent image and a resolution.

However, use of such a short wavelength LD poses some problems in stable operation of a photoreceptor because the wavelength of the short-wavelength LD is shorter than the center oscillation wavelength of a conventional exposure member.

A first problem is concerned with stability of the photoreceptor. Specifically, since a current writing wavelength is longer than 450 nm, writing is allowed from the surface side of the photoreceptor even if a charge transport material of the charge transport layer is yellow. However, in the case of the short-wavelength LD when the charge transport material blocks the writing light, not only photosensitivity is deteriorated, but also deterioration of the charge transport material itself is promoted, with the result that the very thing of the function of the photoreceptor is deteriorated.

Therefore, when the short-wavelength LD is used, it is essential to use an optically near-colorless one as the charge transport material and it is necessary to develop such a charge transport material. To deal with this problem, a material is selected which has a molecular structure providing a nearly colorless transparent film after the film is formed, from among the charge transport materials which have been developed so far.

A second problem is concerned with stability of the charge generation material. Specifically, as compared with a light absorption and charge generation process along with light absorption for the near-infrared laser, those for the short-wavelength light are largely different in a point of interaction with a material. In other words, energy of the short-wavelength light is clearly larger than that of the current infrared laser when the same charge generation material is used, which allows the occurrence of such an idea that excess energy causes a secondary action during the course extending to the process of creating carriers by light. Though the details of the process are not clear, this is given as a problem concerning stability of the photoreceptor.

Methods resulting from the grappling with an improvement in resolution by using a short-wavelength laser are seen in examples including a method described in Japanese Unexamined Patent Publication No. HET 9(1997)-240051 and methods using a combination of various charge generation materials as shown in, for example, Japanese Unexamined Patent Publication No. 2000-47408 and Japanese Unexamined Patent Publication No. 2000-105479. However, neither "the achievement of high resolution" nor "securance of stability required for the photoreceptor" have been realized yet.

Almost all of the market of a group of materials used for a photoreceptor are currently occupied by organic materials in point of performances and/or costs. However, inorganic compounds featured by, for example, durability and/or stability may also be used as the photoreceptor to be introduced into a special market.

Therefore, hybridization capable of drawing features of the both is desired earnestly. As to inorganic compounds that have been already put into practical use, various inorganic compounds are introduced for a performance of a photoreceptor.

Further, there is an example in which metal oxide particles are introduced into a charge generation layer to intend to achieve an improvement in stability as described in Japanese Unexamined Patent Publication No. HEI 5(1993)-249708.

Moreover, there are descriptions concerning the influence of the light absorption of a metal oxide in the undercoat layer on the characteristics of sensitivity of the photoreceptor in Japanese Unexamined Patent Publication No. 2007-233347. However, it may be said that its effect is still insufficient.

SUMMARY OF THE INVENTION

According to an aspect of the present invention, there is provided an electrophotographic photoreceptor comprising at least a photosensitive layer formed by laminating a charge generation layer containing a charge generation material and a charge transport layer containing a charge transport material in this order, on a conductive support, wherein the charge generation layer contains an oxotitanylphthalocyanine as the charge generation material and metal oxide microparticles, and the electrophotographic photoreceptor has photosensitive properties in light source of wavelength range from 360 to 420 nm.

According to another aspect of the present invention, there is provided an image information device comprising the electrophotographic photoreceptor as mentioned above, a charge means for charging the electrophotographic photoreceptor, an exposure means for exposing the charged electrophotographic photoreceptor to light corresponding to image information to form an electrostatic latent image, a developing means for developing the electrostatic latent image formed by the exposure to visualize the image, and a transfer means for transfer the image visualized by the developing to a recording medium, wherein the exposure means has a light source having the center oscillation wavelength in a wavelength range from 360 to 420 nm.

DESCRIPTION OF THE PREFERRED EMBODIMENTS

The present invention has been made in view of the above situation of prior art technologies and it is an object of the present invention to provide a photoreceptor which is so designed that it has good dot reproducibility when short-wavelength light is used as a writing light source and is superior in durability and which has satisfactorily long life, high resolution and high image quality and also to provide an image formation device provided with the photoreceptor.

The photoreceptor of the present invention comprises at least a photosensitive layer formed by laminating a charge generation layer containing a charge generation material and a charge transport layer containing a charge transport material in this order, on a conductive support, wherein the charge generation layer contains an oxotitanylphthalocyanine as the charge generation material and metal oxide microparticles, and the electrophotographic photoreceptor has photosensitive properties in light source of wavelength range from 360 to 420 nm.

According to the present invention, a photoreceptor which is so designed that it has good dot reproducibility at a wavelength of a writing light source when short-wavelength light is used as a writing light source and is superior in durability and which has satisfactorily long life, high resolution and high image quality and also to provide an image formation device provided with the photoreceptor can be provided.

A structure of the photoreceptor of the present invention will be explained in detail with reference to FIG. 1, on the premise that the present invention is not limited to the following embodiments.

Figure 1:
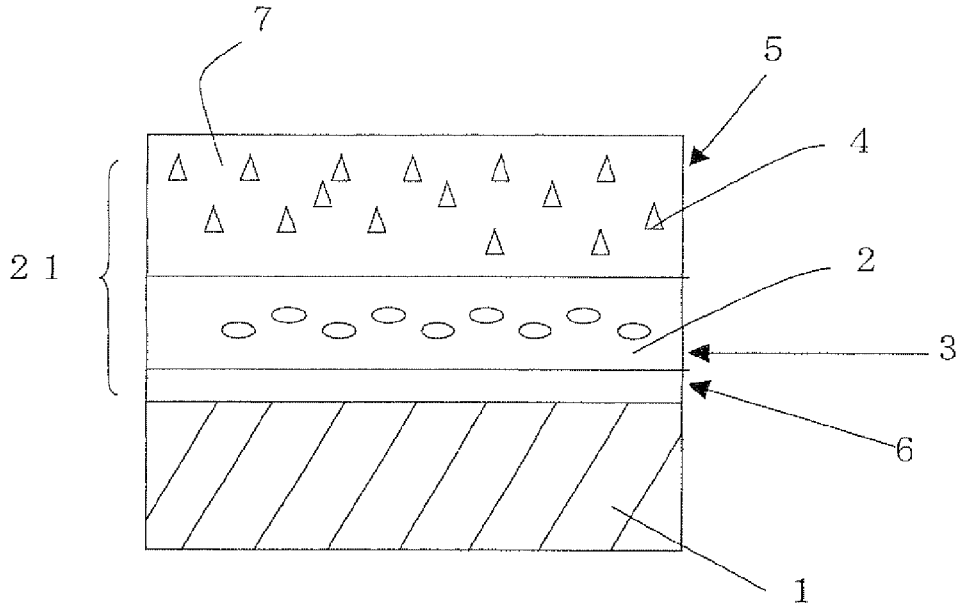
FIG. 1 is a schematic sectional view showing the structure of an essential part of a photoreceptor according to the present invention.

FIG. 1 is a schematic sectional view showing a structure of an essential part of the photoreceptor of the present invention. A photosensitive layer (laminate type photosensitive layer) 21 in which an undercoat layer 6, a charge generation layer 3 containing a charge generation material 2 and a charge transport layer 5 containing a charge transport material 4 are laminated in this order is laminated on a conductive substrate 1. In FIG. 1, 7 represents a binder resin (binding resin).

The photoreceptor of the present invention preferably has the above laminate type though it may have an inverse two-layer laminate structure in which the charge generation layer and charge transport layer are laminated in inverse order.

[Conductive Substrate (Conductive Support) 1]

The conductive substrate 1 plays a role of the electrode of the photoreceptor and also doubles as a support for other each layer.

Any material may be used without any particular limitation as long as it is a material used in the fields concerned.

Specific examples of the structural material of the conductive support include metal materials such as aluminum, copper, brass, zinc, nickel, stainless, chromium, molybdenum, vanadium, indium, titanium, gold and platinum; alloy materials such as an aluminum alloy; and structural materials prepared by laminating a metal foil, forming a metal material by vapor deposition or forming a layer of a conductive compound such as a conductive polymer, tin oxide or indium oxide by vapor deposition or application, on a surface of a substrate made of high-molecular materials such as a polyethylene terephthalate, polyamide, polyester, polyoxymethylene and polystyrene, hard paper or glass.

The conductive substrate is processed into a cylindrical form, columnar form, thin film sheet form or endless belt form prior to use. When each layer is formed on a conductive substrate by a dip coating method, the conductive substrate preferably has a cylindrical form.

According to necessity, the surface of the conductive substrate 1 may be subjected to anodic oxidation coating treatment, surface treatment using chemicals or hot water, coloring treatment or irregular reflection treatment in which the surface is roughened to the extent that an image is not adversely affected.

The irregular reflection treatment is particularly effective when the photoreceptor according to the present invention is used in an electrophotographic process using a laser as an exposure light source. Specifically, in the electrophotographic process using a laser as the exposure light source, wavelengths of the laser light are even and therefore, the laser light reflected on a surface of the photoreceptor and the laser light reflected in the inside of the photoreceptor are interfered with each other, which is probably the cause of generation of image defects because an interference fringe resulted from the above interference appears on the image. Therefore, the image defects due to the interference of laser light having even wavelengths can be prevented by processing a surface of a conductive support by the irregular reflection treatment.

[Undercoat Layer (Intermediate Layer) 6]

The photoreceptor of the present invention is preferably provided with an undercoat layer between the conductive substrate 1 and the photosensitive layer 21.

The undercoat layer has a function to prevent charges from being injected into the photosensitive layer from the conductive substrate. Specifically, it prevents deterioration in charging ability in repeated use and improves the charging ability under a low-temperature/low-humidity environment to limit reduction in surface charge on the part other than that to be erased, thereby preventing generation of image defects such as fogging. In particular, the undercoat layer prevents generation of image fogging called black points formed as small black dots made of a toner on a white background part in the formation of an image by the inverse developing process.

Further, the undercoat layer reduces a level of scratches and irregularities which are defects on the surface of the conductive substrate to thereby make the surface uniform, making it possible to improve a film forming ability of the photosensitive layer and to improve adhesion between the conductive support and the laminate type photosensitive layer.

The undercoat layer may be formed, for example, by dissolving or dispersing a resin material in a proper solvent to prepare an undercoat layer coating solution, which is then applied to a conductive support, followed by drying to remove the solvent.

Examples of the resin material include synthetic resins such as a polyamide, polyvinyl alcohol, polyurethane, polyester, epoxy resin and phenol resin and natural high-molecular materials such as casein, cellulose and gelatin. These materials may be used either singly or in combinations of two or more. Among these materials, a polyamide resin is preferable and an alcohol-soluble nylon resin is more preferable.

Examples of the alcohol-soluble nylon resin include copolymer nylons obtained by copolymerizing 6-nylon, 6,6-nylon, 6,10-nylon, 1'-nylon and 12-nylon; and resins obtained by chemically denaturing nylons such as N-alkoxymethyl-denatured nylon and N-alkoxyethyl-denatured nylon.

Examples of the solvent used to dissolve or disperse the resin material include single solvents such as water, methanol, ethanol or butanol, mixed solvents of water and alcohols, mixed solvents of two or more alcohols, mixed solvents of acetone or dioxolan and alcohols and mixed solvents of chlorine solvents such as dichloroethane, chloroform or trichloroethane and alcohols.

Further, the undercoat layer coating solution may contain inorganic pigments such as zinc oxide, titanium oxide, tin oxide, indium oxide, silica or antimony oxide with the view of, for example, regulating volume resistance and improving repeat aging characteristics under a low-temperature/low-humidity environment.

A ratio of an inorganic pigment in an undercoat layer is preferably 30 to 95% by weight. When inorganic pigments are added in the undercoat layer coating solution, it is preferable to disperse these pigments by using a dispersing machine such as a ball mill, a dino-mill or an ultrasonic oscillator.

Though no particular limitation is imposed on the coating method, a dip coating method is particularly preferable. In the dip coating method, a cylindrical conductive substrate is dipped in a coating vessel filled with a coating solution and then, the substrate is pulled up at a fixed rate or an arbitrarily varied rate to form a layer. This method is therefore relatively simple and is superior in productivity and cost and therefore, is frequently used in the case of producing a photoreceptor.

Accordingly, this method is used for forming not only the undercoat layer but also the charge generation layer, charge transport layer and protective layer which will be explained later.

The coating film may be dried using hot air or near-infrared rays, wherein a drying temperature is preferably about 40 to 130° C. and a drying time is preferably about 10 minutes to 2 hours. When the drying temperature is excessively low, there is the case where the drying time is prolonged whereas when the drying temperature is excessively high, there is the case where the electric characteristics in repeat use are impaired, causing deterioration of an image obtained using the photoreceptor.

The film thickness of the undercoat layer is generally about 0.1 to 5 μm, though no particular limitation is imposed on the film thickness.

When the structural material of the conductive support is aluminum, a layer containing alumite (alumite layer) is formed as an undercoat layer.

[Charge Generation Layer 3]

The charge generation layer 3 contains a charge generation material that absorbs light to generate charges as its major component and contains a binder resin according to need. The major component means that its component is contained in an amount enough to develop its primary function.

The present invention is characterized primarily by a feature that the charge generation layer contains oxotitanylphthalocyanine as the charge generation material and metal oxide microparticles.

The oxotitanylphthaloeyanine of the present invention is a compound represented by the following formula (A):

(A)

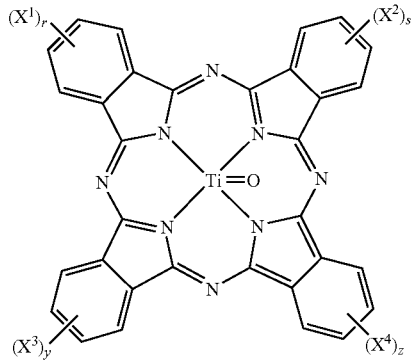

wherein $X^1$, $X^2$, $X^3$ and $X^4$, which may be the same or different, respectively represent a halogen atom, an alkyl group or an alkoxy group, and r, s, y and z, which may be the same or different, respectively denote an integer from 0 to 4.

Examples of the halogen atom represented by $X^1$, $X^2$, $X^3$ or $X^4$ in the formula (A) include a fluorine, chlorine, bromine or iodine atom.

Examples of the alkyl group represented by $X^1$, $X^2$, $X^3$ or $X^4$ include alkyl groups having 1 to 4 carbon atoms such as a methyl group, ethyl group, propyl group, isopropyl group, butyl group, isobutyl group and t-butyl group.

Examples of the alkoxy group represented by $X^1$, $X^2$, $X^3$ or $X^4$ include alkoxy groups having 1 to 4 carbon atoms such as a methoxy group, ethoxy group, propoxy group, isopropoxy group, butoxy group, isobutoxy group and t-butoxy group.

The oxotitaniumphthalocyanine compound represented by the formula (A) may be manufactured by known production methods such as the method as described in Moser, Frank H and Arthur L. Thomas, "Phthalocyanine Compounds, Reinhold Publishing Corp., New York, 1963.

In the case of, for example, unsubstituted oxotitaniumphthalocyanine obtained when r, s, y and z are 0 among the oxotitanium phthalocyanine compounds represented by the above formula (A), phthalylnitrile and titanium tetrachloride are melted by heating or by reacting under heating in a proper solvent such as α-chloronaphthalene to synthesize dichlorotitaniumphthalocyanine, which is then hydrolyzed using a base or water to obtain an unsubstituted oxotitaniumphthalocyanine.

Further, oxotitaniumphthalocyanine can also be produced by reacting isoindoline with titanium tetraalkoxide such as tetrabutoxytitanium under heating in a proper solvent such as N-methylpyrrolidone.

Figure 2:
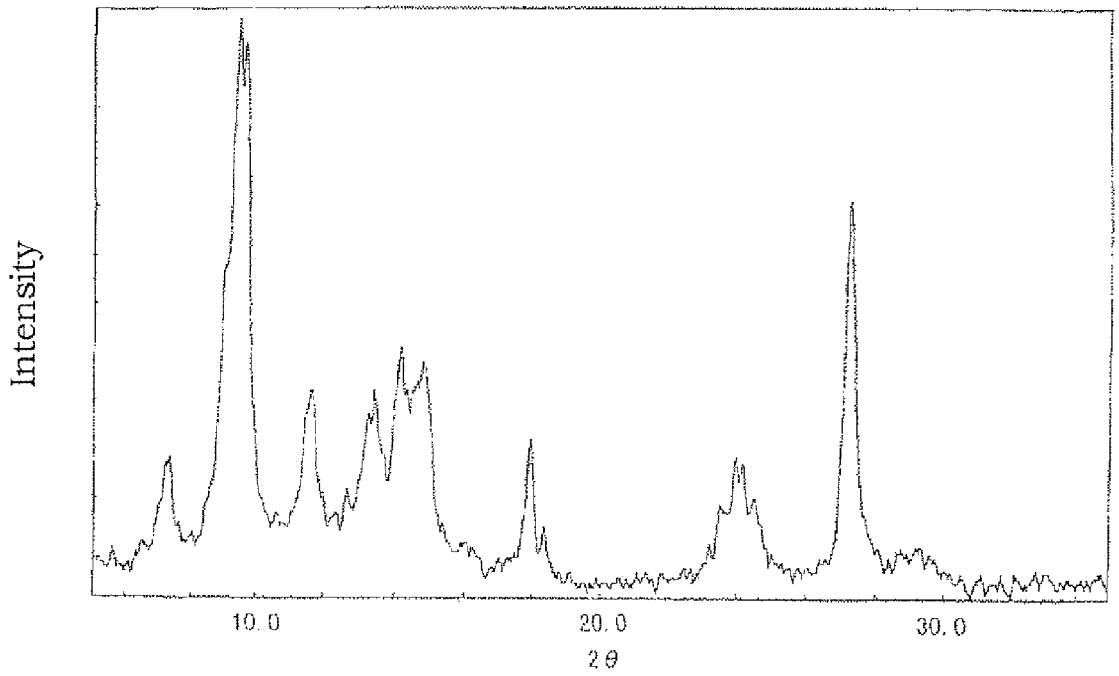
FIG. 2 is an X-ray diffraction spectrum of oxotitanylphthalocyanine that is a charge generation material preferable for a photoreceptor according to the present invention (Example 2)

The oxotitanylphthalocyanine of the present invention is preferably the above-mentioned unsubstituted oxotitanylphthalocyanine crystal having a specified crystal type which has a maximum diffraction peak at a brag angle (2θ±0.2°) of 9.4° or 9.7° in an X-ray diffraction spectrum and clear diffraction peaks at brag angles of, at least, 7.3°, 9.4°, 9.7° and 27.3° (see FIG. 2).

The photoreceptor containing such a specified crystal type oxotitanylphthalocyanine is highly sensitive and therefore can provide a high-quality image, is superior in potential stability in repeated use and can also efficiently suppress occurrence of background fogging in an electrophotographic process using an inverse developing. With regard to electric stability, the similar stable electric characteristics can be provided not only when a photoreceptor is irradiated with a near-infrared laser (780 nm) but also when, for example, a GaN type semiconductor laser having, for example, a center oscillation wavelength of 405 nm is used in the case of a short-wavelength light source.

Examples of the metal oxide microparticles include oxides such as silicon oxide (silica), titanium oxide, zinc oxide, calcium oxide and aluminum oxide (alumina). Among these compounds, titanium oxide and zinc oxide having excellent characteristics as a n-type semiconductor microparticles and zinc oxide is more preferable.

Further, metal nitride particles such as silicon nitride or aluminum nitride may be used in place of the metal oxide particles.

A particle diameter of the metal oxide microparticles is preferably 100 nm or less and more preferably in a range from 5 to 100 nm. When the particle diameter is less than 5 nm or exceeds 100 nm, it is difficult to obtain an effect that will be obtained by the addition. When the particle diameter exceeds 100 nm, there is the case where the film quality for the charge generation layer is deteriorated and mechanical strength as the photoreceptor is impaired.

In the present invention, the term "particle diameter" means "primary particle diameter", unless otherwise noted.

It is considered that a stable and highly sensitive photoreceptor is attained through the following processes by using a short-wavelength light source (light source having the center oscillation wavelength in a wavelength range from 360 to 420 nm) in the presence of oxotitanylphthalocyanine and metal oxide microparticles.

Specifically, charges are excited to a higher-order energy level by light absorption of oxotitanylphthalocyanine and then, changed to free carriers through the lowest excitation level. During this process, these charges are subsidiary caught by a trap (trap creation), bringing about unstable sensitivity. Here, it is considered that the above trap creation is limited by some interaction with the conductive band of the metal oxide microparticles close to oxotitanylphthalocyanine. Then) it is considered that light absorption of the metal oxide microparticles and a subsequent process of generation of a carrier also contribute to an improvement in sensitivity.

Oxotitanylphthalocyanine may be combined with other charge generation material to the extent that the effect of the present invention is not impaired. When the oxotitanylphthalocyanine is used in combination with other charge generation material, a light decay curve can be controlled freely and easily, which is advantageous because a degree of freedom is widened in designing an image formation process.

Examples of such charge generation material include organic pigments or dyes (organic photoconductive materials) such as azo pigments (for example, monoazo pigments, bisazo pigments and trisazo pigments), indigo pigments (for example, indigo and thioindigo), perylene pigments (for example, perylene imide and perylenic acid anhydride), polycyclic quinone pigments (for example, anthraquinone and pyrene quinone), phthalocyanine pigments (for example, metal phthalocyanine and nonmetal phthalocyanine), squalilium dyes, pyrylium salts and thiopyrylium salts, triphenylmethane dyes (for example, Methyl violet, Crystal Violet, Night Blue and Victoria Blue), acridine dyes (for example, erythrosine, Rhodamine B, Rhodamine 3R, Acridine Orange and Flapeosine), thiazine dyes (for example, Methylene Blue and Methylene Green), oxazine dyes (Capryl Blue, Meldola's Blue), bisbenzoimidazole dyes, quinacridone dyes, quinoline dyes, lake dyes, azo lake dyes, dioxazine dyes, azulenium dyes, triallylmethane dyes, xanthene dyes and cyanine dyes, and further, inorganic materials (inorganic photoconductive materials) such as serene and amorphous silicon.

A content of the metal oxide microparticles in the charge generation layer is preferably 1 to 100% by weight and more preferably 20 to 80% by weight based on the charge generation material.

When the content of the metal oxide microparticles is less than 1% by weight, no clear effect of the addition is obtained whereas when the content of the metal oxide microparticles exceeds 100% by weight, there is the case where harmful effects such as deterioration in charging ability become significant.

As the binder resin, a resin which is usually used for the purpose of improving a mechanical strength and durability of the charge generation layer and has binding ability enough for use in the fields concerned may be used.

Specific examples of the binder resin include thermoplastic resins such as a polymethylmethacrylate, polystyrene and vinyl resins, for example, a polyvinyl chloride, polycarbonate, polyester, polyester carbonate, polysulfone, polyarylate, polyamide, methacryl resin, acryl resin, polyether, polyacrylamide and polyphenylene oxide; thermosetting resins such as a phenoxy resin, epoxy resin, silicone resin, polyurethane, phenol resin, alkyd resin, melamine resin, phenoxy resin, polyvinylbutyral and polyvinylformal, partially crosslinked products of these resins, copolymer resins having two or more structural units included in these resins (insulation resins such as vinyl chloride/vinyl acetate copolymer resins, vinyl chloride/vinyl acetate/maleic acid anhydride copolymer resins and acrylonitrile/styrene copolymer resins). These binder resins may be used either singly or in combinations of two or more.

The charge generation layer may be formed by the known drying method or wet method.

Examples of the dry method include a method in which the charge generation material is vapor-deposited on the conductive support or the undercoat layer.

Examples of the wet method include a method in which oxotitanylphthalocyanine as the charge generation material, metal oxide microparticles and binder resin are dissolved or dispersed in a proper solvent to prepare a charge generation layer coating solution, which is then applied to the surface of the conductive support or the undercoat layer, followed by drying to remove the solvent. In this case, examples of the coating method include the same dip coating method that is used for the undercoat layer.

The dip coating method is relatively simple and is superior in productivity and cost, and therefore, the latter wet method is preferable.

Examples of the solvent include aromatic hydrocarbons such as benzene, toluene, xylene, mesitylene, tetralin, diphenylmethane, dimethoxybenzene and dichlorobenzene; halogenated hydrocarbon such as dichloromethane, dichloroethane and tetrachloropropane; ethers such as tetrahydrofuran (THF), dioxane, dibenzyl ether, dimethoxymethyl ether and 1,2-dimethoxyethane; ketones such as methyl ethyl ketone, cyclohexanone, acetophenone and isophrone; esters such as methyl benzoate, ethyl acetate and butyl acetate; sulfur-containing solvents such as diphenyl sulfide; fluorine solvents such as hexafluoroisopropanol; and aprotic polar solvents such as N,N-dimethylformamide and N,N-dimethylacetamide. These compounds may be used either singly or in a mixed solvent. In addition, mixed solvents obtained by adding alcohols, acetonitrile or methyl ethyl ketone to the above solvents may be used. Among these solvents, non-halogen organic solvents are more preferable in consideration of global environments.

A preferable charge generation layer coating solution in this embodiment of the present invention is constituted of oxotitanylphthalocyanine, metal oxide microparticles, a butyral resin as the binder resin, silicone oil and a mixed solvent of two or more non-halogen organic solvents (preferably, a mixed solvent of dimethoxyethane and cyclohexanone).

The content of the charge generation material in the charge generation layer is preferably 30 to 90% by weight and more preferably 40 to 80% by weight. When a content of the charge generation material is in the above range, excellent effects of the present invention are obtained.

The charge generation layer may contain one or more chemical sensitizers and optical sensitizers in an appropriate amount to the extent that preferable characteristics of the present invention are not impaired. These sensitizers improve sensitivity of the photoreceptor and restrain a rise in residual potential and fatigue caused by repeat use to thereby improve the electrical durability of the photoreceptor. These sensitizers may be contained in the charge transport layer or may be contained in both the charge generation layer and the charge transport layer.

A proportion of the chemical sensitizer and/or optical sensitizer to be used is, though not particularly limited to, preferably 10 parts by weight or less and particularly preferably 0.5 to 2.0 parts by weight based on 100 parts by weight of the charge generation material.

Examples of the chemical sensitizer (electron accepting material) include electron attractive materials, for example, acid anhydrides such as succinic acid anhydride, maleic acid anhydride, phthalic acid anhydride and 4-chloronaphthalic acid anhydride; cyano compounds such as tetracyanoethylene and terephthalmalondinitrile; aldehydes such as 4-nitrobenzaldehydes; anthraquinones such as anthraquinone and 1 nitroanthraquinone; polycyclic or heterocyclic nitro compounds such as 2,4,7-trinitrofluorenone and 2,4,5,7-tetranitrofluorenone; and diphenoquinone compounds, and macromolecular compounds obtained by polymerizing these electron attractive materials.

The charge generation layer may contain one or two or more types selected from hole transport materials, electron transfer materials, antioxidants, ultraviolet absorbers, dispersion stabilizers, leveling agents, plasticizers and microparticles of inorganic compounds or organic compounds in an appropriate amount according to need.

Examples of the antioxidant and ultraviolet absorber include hindered amine compounds, hydroquinone compounds, tocopherol compounds, paraphenylenediamine, arylalkane and their derivatives, amine compounds, organic sulfur compounds and organic phosphorous compounds. Among these materials, hindered phenol derivatives are particularly preferable.

An amount of the antioxidant to be used is preferably 0.1 to 50 parts by weight and more preferably 1 to 20 parts by weight based on 100 parts by weight of the charge transport material. When the amount of the antioxidant is less than 0.1 parts by weight, there is the ease where only insufficient effects are obtained for improving stability of a coating solution and durability of a photoreceptor. Further, when the amount of the antioxidant exceeds 50 parts by weight, there is the case where the characteristics of the photoreceptor are adversely affected.

The plasticizer and leveling agent can prevent the orange peel and can improve film forming ability, flexibility and surface smoothness.

Examples of the plasticizer include biphenyl, biphenyl chloride, benzophenone, o-terphenyl, dibasic acid ester (for example, phthalates), aliphatic acid ester, phosphate, various fluoro hydrocarbon, paraffin chloride or epoxy plasticizers.

Examples of the leveling agent (surface modifier) may include silicone type leveling agents such as a silicone oil and fluororesin leveling agent.

These microparticles of inorganic compound or inorganic compound can reinforce mechanical strength and improve the electric characteristics.

A film thickness of the charge generation layer is, though not particularly limited to, preferably 0.05 to 5 μm and more preferably 0.1 to 1.5 μm. When the film thickness of the charge generation layer is less than 0.05 μm, there is a fear that light absorption efficiency is dropped, bringing about low sensitivity, whereas when the film thickness of the charge generation layer exceeds 5 μm, charge transportation in the charge generation layer is a rate determining step in the process of erasing charges on a surface of the photoreceptor, and there is therefore a fear that sensitivity is deteriorated.

[Charge Transport Layer 5]

The charge transport layer 5 contains a charge transport material having an ability to accept and transport the charges generated in charge generation material, a binder resin, and according to need, a known plasticizer and sensitizer.

Examples of the charge transport material include electron-donating materials such as a poly-N-vinylcarbazole and its derivatives, poly-γ-carbazolylethyl glutamate and its derivatives, pyrene-formaldehyde condensate and its derivative, polyvinylpyrene, polyvinylphenanthrene, oxazole derivatives, oxadiazole derivatives, imidazole derivatives, 9-(p-diethylaminostyryl)anthracene, 1,1-bis(4 dibenzylaminophenyl)propane, styrylanthracene, styrylpyrazoline, pyrazoline derivatives, phenylhydrazones, hydrazone derivatives, triphenylamine compound, triphenylmethane compound, stilbene compound and azine compound having 3-methyl-2-benzothiazoline ring; and electron-accepting materials such as fluorenone derivatives, dibenzothiophene derivatives, indenothiophene derivatives, phenanthrenequinone derivatives, indenopyridine derivatives, thioxanthone derivatives, benzo[c]cinnoline derivatives, phenazine oxide derivatives, tetracyanoethylene, tetracyanoquinodimethane, bromanil, chloranil and benzoquinone.

When the photoreceptor is used in an image information device with an exposure means using a writing exposure light source having a center oscillation wavelength in a wavelength range from 360 to 420 nm, an arylamine compound having no absorption in a wavelength range above 360 nm is more preferable as the charge transport material.

As the binder resin, a material of a type which is compatible with the charge transport material and has no absorption in a wavelength range of 360 nm or more are preferable. Examples of the binder resin include a polycarbonate and copolymer polycarbonate, polyarylate, polyvinylbutyral, polyamide, polyester, epoxy resin, polyurethane, polyketone, polyvinyl ketone, polystyrene, polyacrylamide, phenol resin, phenoxy resin, polysulfone resin and their copolymer resins. These binder resins may be used either singly or in combinations of two or more thereof. Among these binder resins, resins such as a polystyrene, polycarbonate, copolymer polycarbonate, polyarylate and polyester have a volume resistance of $10^{13}\Omega$ or More and are also superior in film-forming ability and potential characteristics.

The charge transport layer may be formed in the same manner as the charge generation layer. Specifically, the charge transport layer is preferably formed using a method in which a charge transport material and a binder resin are dissolved or dispersed in a proper solvent to prepare a charge transport layer coating solution, which is then applied to the charge generation layer by a dip coating method, followed by drying to remove the solvent.

Examples of the solvent used to dissolve the binder resin include alcohols such as methanol and ethanol, ketones such as acetone, methyl ethyl ketone and cyclohexanone, ethers such as ethyl ether, tetrahydrofuran, dioxane and dioxolan, aliphatic halogenated hydrocarbon such as chloroform, dichloromethane and dichloroethane and aromatics such as benzene, chlorobenzene and toluene.

A ratio of the charge transport material in the charge transport layer is preferably in a range from 30 to 80% by weight and more preferably 40 to 70% by weight. When the ratio of the charge transport material is in the above range, an excellent effect of the present invention is obtained.

A film thickness of the charge transport layer is, though not particularly limited to, preferably 10 to 30 μm and more preferably 10 to 20 μm. In the case where the film thickness of a charge transport layer which is usually applied is 20 to 30 μm, carriers are diffused in an in plane direction in the charge transport layer, so that an electrostatic latent image is expanded and formation of an image having high resolution is hindered even if a beam diameter of the light source. In order to prevent this phenomenon, it is necessary to more decrease the film thickness of the charge transfer layer.

Filler particles may be added with a purpose of suppressing abrasive deterioration of a surface of a photoreceptor which deterioration is caused by sliding contact with a cleaning blade of an image formation device.

Such a filler is roughly classified into an organic filler particle and an inorganic filler including a metal oxide.

Generally, an organic filler including a fluorine material is used for the purpose of controlling the wettability of a surface of a photoreceptor and suppressing adhesion of foreign substances. On the other hand, an inorganic filler is used for the purpose of improving rubbing resistance. It is preferable to use the latter in the present invention.

In the photoreceptor of the present invention, the charge transport layer preferably contains inorganic filler particles and the inorganic fillers are preferably contained in the charge transport layer in such a dispersed state that the following equation (1) is satisfied;

$$1.0\times10^{-3}\leqq(df\times b^3/(dm\times a^3)\leqq25\times10^{-2} \quad (1)$$

wherein a is an average distance between fillers (nm), b is an average particle diameter of fillers (nm), df is the a density of filler particles ($g/cm^3$) and dm is an average density ($g/cm^3$) of a solid in the charge transfer layer.

The above formula (1) is established on a premise that filler particles have a true sphere form and are uniformly distributed in a homogeneous solid medium and that these particles are closely packed in the above medium.

In this case, the solid medium means a binder resin and a charge transport material constituting a charge transport layer and the Filler particles are distributed uniformly.

An average distance a between fillers is preferably measured precisely by TEM observation of the section. However, it may be found as a value calculated from the amount of the filler particles and volume of the coating film which is a medium if a uniformly dispersed state is confirmed. Specifically, the average distance a can be measured from an amount, a particle diameter and a density of the filler particles to be added and the density of the medium (to say exactly, the density of all solid content containing the filler particles).

Though an average particle diameter b of the filler particles is preferably measured precisely by SEM observation of the section, it may be referred to the value described in the catalogues concerned if commercially available fillers are used.

A density df of the filler particles can be calculated from the volume and weight of the filler particles measured before they are used (according to JIS 7112). However, it may be referred to a value described in the catalogues concerned if commercially available fillers are used.

An average density dm of the solid in the charge transport layer can be calculated from the volume and weight of the coating film measured after the coating film is formed. Herein, a solid content of the charge transport layer means the amount of the coating film of the charge transport layer obtained by applying the coating solution and solidifying by drying to remove a solvent.

The inorganic filler particles are preferably those characterized by the features that they have a high hardness and are easily dispersed in a binder resin. Examples of the inorganic filler particles include oxides such as silicon oxide (silica), titanium oxide, zinc oxide, calcium oxide, aluminum oxide (alumina) and nitrides such as silicon nitride and aluminum nitride.

Among these compounds, silicon oxide (silica) is more preferable because it is reduced in a difference in a refractive index from the medium taking light scattering into account.

Further, a particle diameter of the inorganic filler particles is preferably 100 nm or less and more preferably in a range from 5 to 100 nm. When the particle diameter is in the above range, harmful effects on scattering of light and electric carriers in the system can be reduced to minimum, whereas when the particle diameter is less than 5 nm or exceeds 100 nm, the effect obtained by the addition of the inorganic filler particles is scarcely obtained.

The average distance a between filler particles is preferably 200 nm or less and particularly preferably 50 to 100 nm.

The density df of the filler particles is preferably 1.3 to 4 $g/cm^2$ and more preferably 1.5 to 3.5 $g/cm^2$.

The average density dm of a solid in the charge transport layer is preferably 1.3 to 3 $g/cm^2$ and particularly preferably 1.4 to 2 $g/cm^2$.

[Protective Layer (Not Shown)]

The photoreceptor of the present invention is preferably provided with a crosslinkable (reactive) protective layer on a surface of the charge transport layer as a means for limiting the abrasive deterioration of a surface of the charge transport layer.

The protective layer is preferably constituted of a binder resin such as an organic silicon compound and, as required, the above metal oxide microparticles, and an amount of the metal oxide microparticles in the charge transport layer is preferably about 0.1 to 30% by weight.

Further, it is preferable to add the above charge transport material and antioxidant in the protective layer according to need. Potential stability and image quality can be improved by the addition of these additives.

Examples of the method of forming the protective layer include a circular amount-limiting coating method according to a method of forming an undercoat layer.

The image information device of the present invention comprises the electrophotographic photoreceptor of claim 1, a charge means for charging the electrophotographic photoreceptor, an exposure means for exposing the charged electrophotographic photoreceptor to light corresponding to image information to form an electrostatic latent image, a developing means for developing the electrostatic latent image formed by the exposure to visualize the image and a transfer means for transfer the image visualized by the developing to a recording medium, wherein the exposure means has a light source having the center oscillation wavelength in a wavelength range from 360 to 420 nm.

The structure and image formation action of the image formation device (laser printer) of the present invention will be explained with reference to the drawing though the following descriptions are not intended to be limiting of the present invention.

Figure 4:
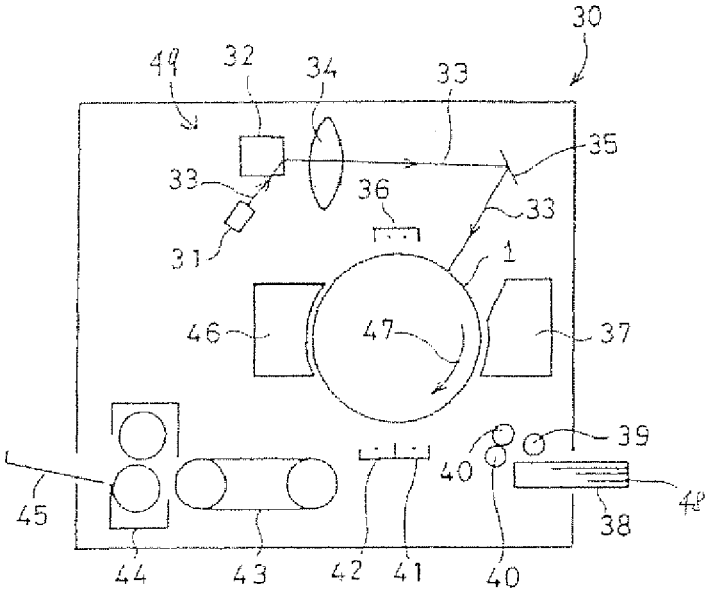
FIG. 4 is a schematic view showing a structure of an essential part of an image formation device according to the present invention.

FIG. 4 is a typical side view showing the structure of the image formation device of the present invention.

A laser printer 30 which is the image formation device is constituted of the following parts contained therein, these parts including a photoreceptor A, a semiconductor laser 31, a rotating polygon mirror 32, an imaging lens 34, a mirror 35, a corona charger 36 which is the charging means, a developer 37 which is the developing means, a transfer paper cassette 38, a paper feed roller 39, a resist roller 40, a transfer charger 41 which is the transfer means, an isolation charger 42, a conveyer belt 43, a fixing device 44, a paper discharge tray 45 and a cleaner 46 which is the cleaning means.

Herein, the above semiconductor laser 31, rotating polygon mirror 32, imaging lens 34 and mirror 35 constitute an exposure means 49.

The photoreceptor A is mounted on the laser printer 30 in such a manner as to be rotatable in the direction of the arrow 47 by a driving means (though not shown). A laser beam 33 emitted from the semiconductor laser 31 is scanned repeatedly in the longitudinal direction (major scanning direction) of a surface of the photoreceptor A by the rotating polygon mirror 32. The imaging lens 34 has a f-θ characteristic and an image is formed on a surface of the photoreceptor A by reflecting the laser beam 33 by using the mirror 35, followed by exposing the image. The laser beam 33 is scanned in the above manner with rotating the photoreceptor A to form an image, thereby forming an electrostatic latent image corresponding to image information on the surface of the photoreceptor A.

The above corona charger 36, developer 37, transfer charger 41, isolation charger 42 and cleaner 46 are disposed in this order from the upstream side to the downstream side in the direction of the rotation of the photoreceptor A as shown by an arrow 47.

Further, the corona charger 36 is disposed on the upstream side of an imaging point of the laser beam 33 in the direction of the rotation of the photoreceptor A to charge the surface of the photoreceptor A uniformly. Therefore, when the surface of the photoreceptor A charged uniformly is exposed, the charge amount of places which are exposed by the laser beam 33 is different from that of parts which are not exposed by the laser beam 33 to thereby form the above electrostatic latent image.

The charger is not limited to a corona charger and may be a corotron charger, a scorotron charger, a saw tooth charger, a roller charger, or the like.

The developer 37 is disposed on the downstream side of the imaging point of the laser beam 33 in the direction of the rotation of the photoreceptor A and supplies a toner to the electrostatic latent image formed on the surface of the photoreceptor A to develop the electrostatic latent image into a toner image. A transfer paper 48 received in the transfer paper cassette 38 is taken out one by one by the paper feed roller 39 and is provided to the transfer charger 41 synchronously with the exposure of the photoreceptor A by the resist roller 40. The toner image is transferred to the transfer paper 48 by the transfer charger 41. The isolation charger 42 disposed close to the transfer charger 41 removes charges from the transfer paper to which the toner image has been transferred, to thereby separate the paper from the photoreceptor A.

The developer may be either a contact type or non-contact type.

In the present invention, an image having high resolution can be formed even by a usual dry one-component or two-component developing means. In this case, the particle diameter of the toner to be used is preferably 6 μm or less.

Though the image formation device of FIG. 4 is used in a dry developing system, the photoreceptor in the image formation device of the present invention is provided with the photosensitive layer and protective layer which have high durability and therefore, a high-quality image is formed even in the case where the developing means is a wet developing system provided with the developing means using a liquid developer in which a toner is dispersed in a hydrocarbon solvent. In this case, toner particles having a particle diameter as small as 1 μm or less and a high charge amount can be used and it is therefore possible to obtain an output image which is free from the disorder of an image and has higher resolution. It is useful to introduce a reactive protective layer in view of improving resistance to a hydrocarbon solvent (organic solvent).

The transfer paper 48 separated from the photoreceptor A is conveyed to the fixing device 44 by the conveyer belt 43 and the toner image is fixed by the fixing device 44. The transfer paper 48 on which an image is thus formed is discharged to the paper discharge tray 45. After the transfer paper 48 is separated by the isolation charger 42, the photoreceptor A continued rotating is cleaned to remove a toner residue and foreign substances left on the surface of the photoreceptor A. The charges of the photoreceptor A the surface of which is cleaned is removed by a charge-removing lamp (not shown) installed together with the cleaner 46 and then, the photoreceptor A is further rotated, and a series of image formation operations starting from the charging of the photoreceptor A are repeated.

Further, a structure capable of forming an overlapped image by using plural toners by providing plural photoreceptors may be adopted. This structure is called "tandem system".

In the image formation device of the present invention, abrasive ability of a cleaning blade and a contact pressure of the cleaning blade which is applied to the surface of the photoreceptor A can be reduced, and therefore, a life of the photoreceptor A is lengthened. Further, a surface of the photoreceptor A after cleaned is free from a toner and foreign substances such as paper powder and is always kept clean, which enables a high-quality image to be formed stably for a long period of time.

Specifically, the image formation device according to the present invention can form an image which is not deteriorated in image quality, stably over a long period of time under a variety of environments. Since the life of the photoreceptor A is long and a simple structure is enough for the cleaner 46, an image formation device reduced in the frequency of maintenance can be attained at low costs. Moreover, because the electric properties of the photoreceptor A are not deteriorated even if it is exposed to light, deterioration in image quality when the photoreceptor is exposed to light can be limited.

The image formation device of the present invention may have the following structure besides the structure shown in FIG. 4.

The photoreceptor A may be integrated with at least one type selected from the corona charger 36, the developer 37 and the cleaner 46 to form a process cartridge.

Examples of the cartridge include a process cartridge obtained by incorporating the photoreceptor A, corona charger 36, developer 37 and cleaner 46, a process cartridge obtained by incorporating the photoreceptor A, corona charger 36 and developer 37, a process cartridge obtained by incorporating the photoreceptor A and cleaner 46 and a process cartridge obtained by incorporating the photoreceptor A and developer 37.

Use of a process cartridge obtained by integrating several members in this manner makes it easy to keep and control the device.

When an outside diameter of the photoreceptor is 40 mm or less, the photoreceptor may have a structure with no isolation charger 42 or may have a structure with no charging-removing lamp (not shown) by devising so as to, for example timely apply high voltage such as developing bias voltage.

Specifically, the charge-removing lamp may be omitted from the viewpoint of space saving in the case of photoreceptors having a small diameter, low-speed low-end printers and the like.

EXAMPLES

The present invention will be explained in detail by way of Examples and Comparative Examples, which are not intended to be limiting of the present invention.

Example 1

A photosensitive layer is formed on a cylindrical conductive substrate having a diameter of 30 mm and made of aluminum to manufacture a photoreceptor and the characteristics of the photoreceptor were evaluated.

7 parts by weight of titanium oxide (trade name: Tipaque TTOSSA, manufactured by Ishihara Sangyo Kaisha, Ltd.) and 13 parts by weight of copolymer nylon (trade name: Amiran CM8000, manufactured by Toray Industries, Ltd.) were added in a mixed solvent of 159 parts by weight of methyl alcohol and 1.06 parts by weight of 1,3-dioxolan and the mixture was dispersed using a paint shaker for 8 hours to prepare an undercoat layer coating solution. This coating solution was filled in a coating tank, and the conductive substrate was dipped and then pulled up, followed by natural drying to form an undercoat layer having a film thickness of 1 μm.

Oxotitanylphthalocyanine which was to be used as the charge generation material and was represented by the following structural formula was obtained in advance in the following manners

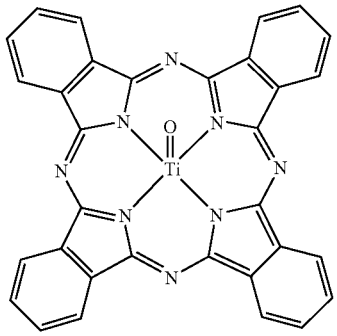

29.2 g of diaminoisoindoline and 200 ml of sulfolane were mixed, thereto was added 17.0 g of titanium tetraisopropoxide to react the mixture at 140° C. in a nitrogen atmosphere for 2 hours. The obtained reaction mixture was allowed to cool and then, the precipitate was collected by filtration. The precipitate was washed with chloroform, an aqueous 2% hydrochloric acid solution, water and methanol in this order, followed by drying to obtain 25.5 g of a bluish-purple needle- or plate-like compound (crystal).

The obtained compound was subjected to chemical analysis, and as a result, confirmed to be oxotitanylphthalocyanine represented by the above formula (yield: 88.5%).

1.8 parts by weight of the obtained oxotitanylphthalocyanine crystal, 0.9 parts by weight of microparticle titanium oxide (trade name; MT-500B (average primary particle diameter: 35 nm), manufactured by Tayca Corporation), 1.2 parts by weight of a butyral resin (trade name: S-LEC BX-1, manufactured by Sekisui Chemical Co., Ltd.) and 0.06 parts by weight of a polydimethylsiloxane silicone oil (trade name: KF-96, manufactured by Shin-Etsu Chemical Co., Ltd.) were mixed in a mixed solvent of 87.3 parts by weight of dimethoxyethane and 9.7 parts by weight of cyclohexanone (ratio=90/10). The mixture was dispersed by a paint shaker for 5 hours to prepare a charge generation layer coating solution. This coating solution was applied to a surface of the undercoat layer formed previously, by the dip coating method in the same manner as in the production of the undercoat layer, followed by natural drying to form a charge generation layer having a film thickness of 0.3 μm.

Then, 5 parts by weight of an arylamine compound represented by the following structural formula, 4.4 parts by weight of a polycarbonate (trade name. Tarflon GH 503, manufactured by Idemitsu Kosan Co., Ltd.) and 3.6 parts by weight of a polycarbonate (trade name: Panlite TS 2040, manufactured by Teijin Chemicals Ltd.) were mixed and 49 parts by weight of tetrahydrofuran was used as a solvent to prepare a charge transport layer coating solution. This coating solution was applied to a surface of the charge generation layer formed previously, by the dip coating method in the same manner as in the production of the undercoat layer, followed by drying at 120° C. for 1 hour to form a charge transport layer having a film thickness of 20 μm. Thus, a photoreceptor in which the undercoat layer, the charge generation layer and the charge transport layer were formed in this order on the conductive substrate as shown in FIG. 1 was formed.

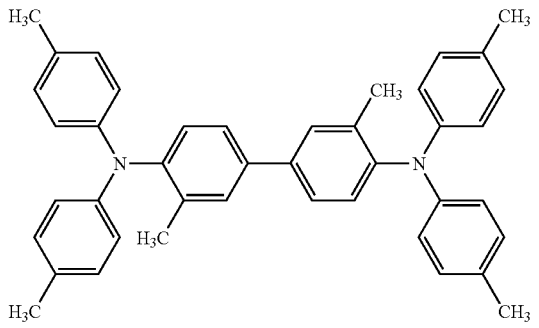

Example 2

Oxotitanylphthalocyanine which was to be used as the charge generation material and was represented by the following structural formula was obtained in advance in the following manner.

40 g of o-phthalodinitrile, 18 g of titanium tetrachloride and 500 ml of α-chloronaphthalene were heated at 200 to 250° C. with stirring in a nitrogen atmosphere for 3 hours to react. Then, the reaction mixture was allowed to cool to 100 to 130° C. and filtered under heating and the residue was washed with α-chloronaphthalene heated to 100° C. to obtain a crude product of dichlorotitanium-phthalocyanine.

The resulting crude product was washed with 200 ml of α-chloronaphthalene and 200 ml of methanol in this order at ambient temperature and then subjected to heat spray washing in 500 ml of methanol. After the product was filtered and the obtained crude product was subjected to heat spray washing in 500 ml of water and this washing was repeated until a pH became 6 to 7. After that, the obtained product was dried to obtain an oxotitanylphthalocyanine intermediate crystal. Then, the obtained intermediate crystal was mixed in methyl ethyl ketone, which was then subjected to milling treatment together with glass beads having a diameter of 2 mm by a paint conditioner (manufactured by Red Level Company), followed by washing with methanol and drying to obtain crystals.

The obtained crystals were subjected to chemical analysis and as a result, it was confirmed that the crystals were oxotitanylphthalocyanine.

Further, as a result of the X-ray diffraction analysis of the obtained crystals, it was confirmed that they were crystal type oxotitanylphthalocyanine which had major diffraction peaks at brag angles (2θ±0.2°) of 7.3°, 9.4°, 9.7° and 27.3° and a maximum diffraction peak in the peak bundle in which the peaks at 9.4° and 9.7° were overlapped (see FIG. 2).

A photoreceptor was manufactured in the same manner as in Example 1 except that oxotitanylphthalocyanine obtained in the above method was used in place of the above oxotitanylphthalocyaine of Example 1 as a charge generation material.

Figure 3:
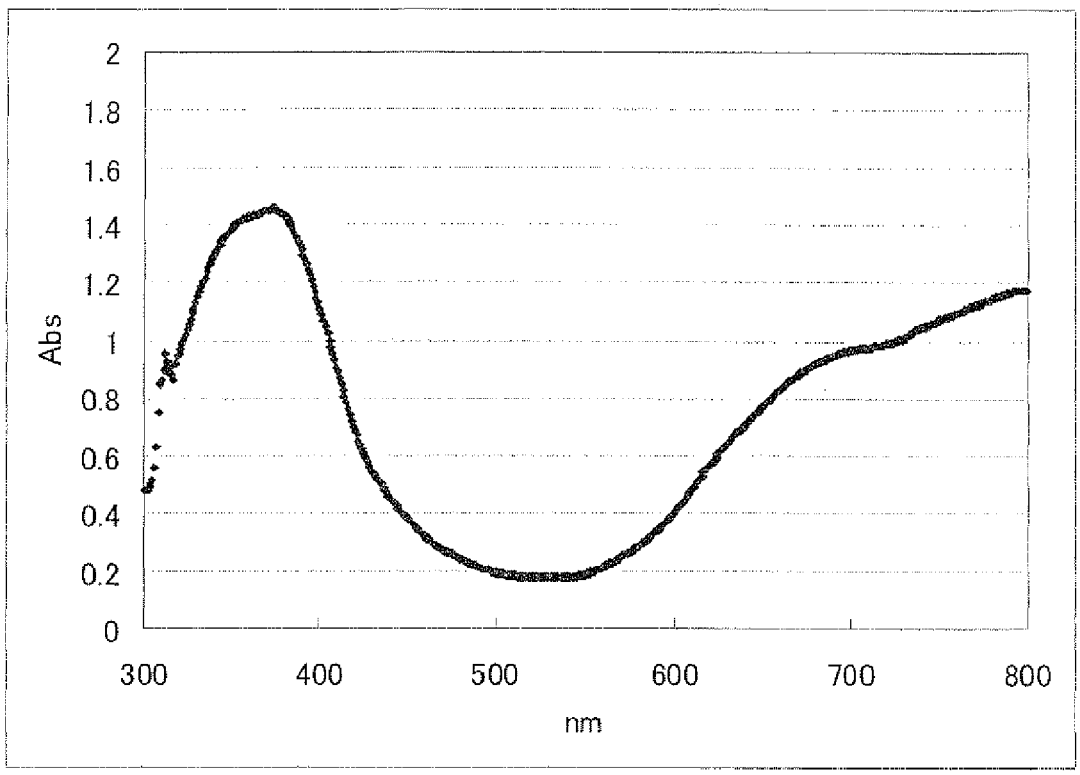
FIG. 3 is a spectral transmission absorption spectrum of a charge generation layer containing oxotitanyl-phthaloeyanine according to the present invention (Example 2)

The spectral transmission absorption spectrum of the charge generation layer was measured. The obtained results are shown in FIG. 3.

Example 3

A photoreceptor was manufactured in the same manner as in Example 2 except that 1.8 parts by weight of oxotitanylphthalocyanine obtained in Example 2, 0.009 parts by weight of microparticle titanium oxide (trade name: MT-500B (average primary particle diameter: 35 nm), manufactured by Tayca Corporation), 1.2 parts by weight of a butyral resin (trade name: S-LEC BX-1, manufactured by Sekisui Chemical Co., Ltd.) and 0.06 parts by weight of a polydimethylsiloxane-silicone oil (trade name: KF-96, manufactured by Shin-Etsu Chemical Co., Ltd.) were dissolved in a mixed solvent of 87.3 parts by weight of dimethoxyethane and 9.7 parts by weight of cyclohexanone (ratio=90/10), and the mixture was dispersed by a paint shaker for 5 hours to prepare a charge generation layer coating solution.

Example 4

A photoreceptor was manufactured in the same manner as in Example 2 except that 1.8 parts by weight of oxotitanylphthalocyanine obtained in Example 2, 0.027 parts by weight of microparticle titanium oxide (trade name: MT500B (average primary particle diameter: 35 nm), manufactured by Tayca Corporation), 1.2 parts by weight of a butyral resin (trade name: S-LEC BX-1, manufactured by Sekisui Chemical Co., Ltd.) and 0.06 parts by weight of a polydimethylsiloxane-silicone oil (trade name: KF-96, manufactured by Shin-Etsu Chemical Co., Ltd.) were dissolved in a mixed solvent of 87.3 parts by weight of dimethoxyethane and 9.7 parts by weight of cyclohexanone (ratio=90/10), and the mixture was dispersed by a paint shaker for 5 hours to prepare a charge generation layer coating solution.

Example 5

A photoreceptor was manufactured in the same manner as in Example 2 except that 1.8 parts by weight of oxotitanylphthalocyanine obtained in Example 2, 1.62 parts by weight of microparticle titanium oxide (trade name: MT 500B (average primary particle diameter: 35 nm), manufactured by Tayca Corporation), 1.2 parts by weight of a butyral resin (trade name: S-LEC BX-1, manufactured by Sekisui Chemical Co., Ltd.) and 0.06 parts by weight of a polydimethylsiloxane-silicone oil (trade name: KF-96, manufactured by Shin-Etsu Chemical Co., Ltd.) were dissolved in a mixed solvent of 87.3 parts by weight of dimethoxyethane and 9.7 parts by weight of cyclohexanone (ratio=90/10), and the mixture was dispersed by a paint shaker for 5 hours to prepare a charge generation layer coating solution.

Example 6

A photoreceptor was manufactured in the same manner as in Example 2 except that 1.8 parts by weight of oxotitanylphthalocyanine obtained in Example 2, 1.98 parts by weight of microparticle titanium oxide (trade name: MT500B (average primary particle diameter: 35 nm), manufactured by Tayca Corporation), 1.2 parts by weight of a butyral resin (trade name: S-LEC BX-1, manufactured by Sekisui Chemical Co., Ltd.) and 0.06 parts by weight of a polydimethylsiloxane-silicone oil (trade name: KF-96, manufactured by Shin-Etsu Chemical Co., Ltd.) were dissolved in a mixed solvent of 87.3 parts by weight of dimethoxyethane and 9.7 parts by weight of cyclohexanone (ratio=90/10), and the mixture was dispersed by a paint shaker for 5 hours to prepare a charge generation layer coating solution.

Example 7

A photoreceptor was manufactured in the same manner as in Example 2 except that 1.8 parts by weight of oxotitanylphthalocyanine obtained in Example 2, 0.9 parts by weight of microparticle titanium oxide (trade name: PT501A (average primary particle diameter: 100 nm), manufactured by Ishihara Kaisha Ltd.), 1.2 parts by weight of a butyral resin (trade name: S-LEC BX-1, manufactured by Sekisui Chemical Co., Ltd.) and 0.06 parts by weight of a polydimethylsiloxane-silicone oil (trade name: KF-96, manufactured by Shin-Etsu Chemical Co., Ltd.) were dissolved in a mixed solvent of 87.3 parts by weight of dimethoxyethane and 9.7 parts by weight of cyclohexanone (ratio=90/10), and the mixture was dispersed by a paint shaker for 5 hours to prepare a charge generation layer coating solution.

Example 8

A photoreceptor was manufactured in the same manner as in Example 2 except that 1.8 parts by weight of oxotitanylphthalocyanine obtained in Example 2, 0.9 parts by weight of microparticle titanium oxide (trade name: PT-501R (average primary particle diameter: 180 nm), manufactured by Ishihara Kaisha. Ltd.)) 1.2 parts by weight of a butyral resin (trade name: S-LEC BX-1, manufactured by Sekisui Chemical Co., Ltd.) and 0.06 parts by weight of a polydimethylsiloxane-silicone oil (trade name. KF-96, manufactured by Shin-Etsu Chemical Co., Ltd.) were dissolved in a mixed solvent of 87.3 parts by weight of dimethoxyethane and 9.7 parts by weight of cyclohexanone (ratio=90/10), and the mixture was dispersed by a paint shaker for 5 hours to prepare a charge generation layer coating solution.

Example 9

A photoreceptor was manufactured in the same manner as in Example 2 except that 1.8 parts by weight of oxotitanylphthalocyanine obtained in Example 2, 1.98 parts by weight of microparticle zinc oxide (trade name; MZ-500 (average primary particle diameter: 20 to 30 μm), manufactured by Tayca Corporation), 1.2 parts by weight of a butyral resin (trade name: S LEC BX-1, manufactured by Sekisui Chemical Co., Ltd.) and 0.06 parts by weight of a polydimethylsiloxane-silicone oil (trade name: KF-96, manufactured by Shin-Etsu Chemical Co., Ltd.) were dissolved in a mixed solvent of 87.3 parts by weight of dimethoxyethane and 9.7 parts by weight of cyclohexanone (ratio=90/10), and the mixture was dispersed by a paint shaker for 5 hours to prepare a charge generation layer coating solution.

Example 10

A photoreceptor was manufactured in the same manner as in Example 2 except that 5 parts by weight of the same arylamine compound that was used in Example 1, 4.4 parts by weight of a polycarbonate (trade name: Tarflon GH 503, manufactured by Idemitsu Kosan Co., Ltd.), 3.6 parts by weight of a polycarbonate (trade name: Panlite TS 2040, manufactured by Teijin Chemicals Ltd.), 0.065 parts by weight of silica filler particles (trade name: TS-610 (average particle diameter: 17 nm), manufactured by Cabot Specialty Chemicals, Inc.) and 49 parts by weight of tetrahydrofuran were mixed and the mixture was dispersed using a ball mill for 6 hours to prepare a charge transport layer coating solution.

Example 11

A photoreceptor was manufactured in the same manner as in Example 2 except that 5 parts by weight of the same arylamine compound that was used in Example 1, 4.4 parts by weight of a polycarbonate (trade name: Tarflon GH 503, manufactured by Idemitsu Kosan Co., Ltd.), 3.6 parts by weight of a polycarbonate (trade name: Panlite TS 2040, manufactured by Teijin Chemicals Ltd.), 0.26 parts by weight of silica filler particles (trade name: TS-610 (average particle diameter: 17 nm), manufactured by Cabot Specialty Chemicals, Inc.) and 49 parts by weight of tetrahydrofuran were mixed and the mixture was dispersed using a ball mill for 6 hours to prepare a charge transport layer coating solution.

Example 12

A photoreceptor was manufactured in the same manner as in Example 2 except that 5 parts by weight of the same arylamine compound that was used in Example 1, 4.4 parts by weight of a polycarbonate (trade name: Tarflon GH 503, manufactured by Idemitsu Kosan Co., Ltd.), 3.6 parts by weight of a polycarbonate (trade name: Panlite TS 2040, manufactured by Tcijin Chemicals Ltd.), 0.39 parts by weight of silica filler particles (trade name: TS-610 (average particle diameter: 17 nm), manufactured by Cabot Specialty Chemicals, Inc.) and 49 parts by weight of tetrahydrofuran were mixed and the mixture was dispersed using a ball mill for 6 hours to prepare a charge transport layer coating solution.

Example 13

A photoreceptor was manufactured in the same mariner as in Example 2 except that 5 parts by weight of the arylamine compound that was used in Example 1, 4.4 parts by weight of a polycarbonate (trade name: Tarflon GH 503, manufactured by Idemitsu Kosan Co., Ltd.), 3.6 parts by weight of a polycarbonate (trade name: Panlite TS 2040, manufactured by Teijin Chemicals Ltd.), 0.39 parts by weight of silica filler particles (trade name: X-24-9163A (average particle diameter: 100 nm), manufactured by Shin-Etsu Chemical Co., Ltd.) and 49 parts by weight of tetrahydrofuran were mixed and the mixture was dispersed using a ball mill for 6 hours to prepare a charge transport layer coating solution.

Example 14

A photoreceptor was manufactured in the same manner as in Example 2 except that 5 parts by weight of the same arylamine compound that was used in Example 1, 4.4 parts by weight of a polycarbonate (trade name: Tarflon GH 503, manufactured by Idemitsu Kosan Co., Ltd.), 3.6 parts by weight of a polycarbonate (trade name: Panlite TS 2040, manufactured by Teijin Chemicals Ltd.), 0.39 parts by weight of silica filler particles (trade name: Adomafine SO-E1 (average particle diameter: 250 nm), manufactured by Adomatechs Company Limited) and 49 parts by weight of tetrahydrofuran were mixed and the mixture was dispersed using a ball mill for 6 hours to prepare a charge transport layer coating solution.

Example 15

An undercoat layer, a charge generation layer and a charge transport layer were laminated in this order on a conductive substrate in the same manner as in Example 2.

Then, 10 parts by weight of a metal alkoxide (tetraethoxysilane: TEOS) and 3 parts by weight of tetraethoxysilane were mixed and the mixture was diluted with 180 parts by weight of monochlorobenzene to prepare a protective layer coating solution. This coating solution was applied to a surface of the charge transport layer by a circular amount-limiting coating method and dried at 120° C. for 1 hour to form a protective layer having a thickness of 1.0 μm. A photoreceptor having a structure in which the protective layer was added to the photoreceptor shown in FIG. 1 was thus obtained.

Comparative Example 1

A photoreceptor was manufactured in the same manner as in Example 2 except that 1.8 parts by weight of oxotitanylphthalocyanine obtained in Example 2, 1.2 parts by weight of a butyral resin (trade name: S-LEC BX-1, manufactured by Sekisui Chemical Co., Ltd.) and 0.06 parts by weight of a polydimethylsiloxane-silicone oil (trade name: KF-96 manufactured by Shin-Etsu Chemical Co., Ltd.) were dissolved in a mixed solvent of 87.3 parts by weight of dimethoxyethane and 9.7 parts by weight of cyclohexanone (ratio=90/10), and the mixture was dispersed by a paint shaker for 5 hours to prepare a charge generation layer coating solution.

(Evaluation)

Each of the photoreceptors manufactured in the above manner in Examples 1 to 15 and Comparative Example 1 together with a charging member (scorotron charger) was set to an image formation device process cartridge of a color composite machine (model: MX-4500N, manufactured by Sharp Kabushiki Kaisha). Using a semiconductor laser having a center oscillation wavelength of 405 nm as the image exposure light source, a writing operation was performed by an image exposure device including a collimator lens, an aperture, a cylinder lens, a polygon mirror, a fθ lens, a barrel-shaped toroidal lens and a reflecting mirror.

A two-component developer (toner having a volume average particle diameter of 6.5 μm) was used to carry out developing, a transfer belt (toner image is transferred directly to transfer paper) was used as the transfer member and a semiconductor laser having a wavelength of 780 nm was used as the charge-removing light source so as to remove charges by applying light to a surface of the photoreceptor. Using a chart having a write ratio of 6%, 50000 sheets were printed under a test environment of 25° C.-50% RH with intermittent every 5 sheets.

The characteristics of the photoreceptor were evaluated in the following manner before and after the 50000 sheets were printed.

<Evaluation of Electric Characteristics>

The potential VL (−V) when printing a solid image was measured using a surface potentiometer (model: Model 344, manufactured by Treck Japan 1K) to rate based on the following standard as the index of sensitivity of a photoreceptor.

VL<100 (V): There is no problem in practical use.

VL≧100 (V): There is an influence on image density and there is a problem in practical use.

<Evaluation of Dot Reproducibility>

A half tone image (one dot image) was formed to rate the condition of formation of dots (the reproducibility, condition of dissipation and profile sharpness of dots) according to the following standard by visual observation.

◎: Good dot reproducibility, no dissipation and excellent profile sharpness.

○: Though there is a slight deterioration in all of the above three items, no problem in practical use.

Δ: Any one of the above three items has a practical problem.

X: Two or more items among three items show the impossibility of practical use.

<Evaluation of Background Dirt>

A white solid image was output to rate a condition of background dirt (the number and size of black spots generated on the background part) according to the following standard (rank) by visual observation.

◎: There is no black spot generated on the background part.

○: Though there is some black spots generated on the background part, these spots are at practically no problematic level.

Δ: Black spots generated on the background part exist in a diffused condition and are at a practically problematic level.

X: There are many black spots generated on the background part and these black spots are at a level not allowing practical use.

<Evaluation of Rubbing Resistance>

A film thickness of the photoreceptor before and after a practical printing test was measured by light interference system film thickness measuring device (model: F20, manufactured by Filmetrics Japan Inc.) and the amount of reduction in a film thickness was found from a difference in a film thickness based on the number of rotations of the photoreceptor drum.

Example 16

Toner particles which had an average particle diameter of 0.8 μm and were obtained by adding carbon black to an acryl resin were dispersed in a hydrocarbon carrier solution (trade name: Isoper L, manufactured by ExxonMobil Chemical Company) to prepare a black negatively charged liquid developer.

The same evaluation as above was made except that a photoreceptor manufactured in the same manner as in Example 2 and the above liquid developer filled in a liquid developer image formation device prepared by improving a dry developer vessel were used. Various evaluations of the image were made.

Comparative Example 2

The same evaluation as above was made except that a photoreceptor manufactured in the same manner as in Example 2 was used and a semiconductor laser having a center oscillation wavelength of 780 nm was used as the image exposure light source.

Results of the above evaluations are shown in Table 1.

TABLE 1

| | Evaluation of Characteristics | | | | | | Reduction in Film |
|---|---|---|---|---|---|---|---|
| | Initial Characteristics | | | After Printing (50k sheets) Characteristics | | | (μm/ |
| | Sensitivity VL (V) | Dot Reproducibility | Background Dirt | Sensitivity VL (V) | Dot Reproducibility | Background Dirt | 100k rotations) |
| Example 1 | 65 | ◎ | ◎ | 90 | ○ | ○ | 1.5 |
| Example 2 | 50 | ◎ | ◎ | 75 | ○ | ○ | 1.4 |

TABLE 1-continued

| | Evaluation of Characteristics | | | | | | Reduction in Film |
|---|---|---|---|---|---|---|---|
| | Initial Characteristics | | | After Printing (50k sheets) Characteristics | | | (μm/ |
| | Sensitivity VL (V) | Dot Reproducibility | Background Dirt | Sensitivity VL (V) | Dot Reproducibility | Background Dirt | 100k rotations) |
| Example 3 | 80 | ◎ | ◎ | 95 | ○ | ○ | 1.5 |
| Example 4 | 75 | ◎ | ◎ | 91 | ◎ | ◎ | 1.4 |
| Example 5 | 45 | ◎ | ◎ | 69 | ◎ | ◎ | 1.4 |
| Example 6 | 41 | ◎ | ◎ | 65 | ◎ | ○ | 1.6 |
| Example 7 | 60 | ◎ | ◎ | 81 | ○ | ○ | 1.5 |
| Example 8 | 80 | ◎ | ◎ | 95 | ○ | ○ | 1.4 |
| Example 9 | 46 | ◎ | ◎ | 59 | ◎ | ◎ | 1.4 |
| Example 10 | 53 | ◎ | ◎ | 79 | ○ | ○ | 1.1 |
| Example 11 | 56 | ◎ | ◎ | 83 | ○ | ○ | 0.8 |
| Example 12 | 63 | ◎ | ◎ | 95 | ○ | ○ | 0.6 |
| Example 13 | 58 | ◎ | ◎ | 91 | ○ | ○ | 0.7 |
| Example 14 | 62 | ○ | ○ | 95 | ○ | ○ | 0.5 |
| Example 15 | 72 | ◎ | ◎ | 93 | ○ | ○ | 0.3 |
| Example 16 | 73 | ◎ | ◎ | 89 | ◎ | ◎ | 0.2 |
| Comparative Example 1 | 79 | Δ | Δ | 75 | X | Δ | 1.5 |
| Comparative Example 2 | 78 | Δ | ○ | 99 | Δ | Δ | 1.3 |

It is found from the results of Examples 1 to 15 that a stable and high-quality image is obtained before and after actual printing by using the photoreceptor of the present invention which is provided with a charge generation layer containing a specified oxotitanylphthalocyanine and metal oxide microparticles in an image formation device provided with a semiconductor laser having a center oscillation wavelength of 405 nm as the exposure light source.

Among these results, it is found that a particularly stable and high-quality image is obtained before and after actual printing in the case of using a specified oxotitanylphthalocyanine (Example 2) and in the case of using specified metal oxide microparticles (Examples 4 and 5).

It is also found that particularly excellent photoreceptor characteristics can be obtained in the case of using a specified metal oxide microparticles (zinc oxide) (Example 9).

Moreover, it is found that the compatibility with the rubbing resistance can be attained in the case of adding an inorganic filler to the charge transport layer (Examples 10 to 14) and in the case of disposing a protective layer on a surface of the charge transport layer (Example 15) and the compatibility between image quality and the highest rubbing resistance is attained in the case of, particularly, Example 11.

It is also found from the results of Example 16 that a stable and high-quality image is obtained before and after actual printing in the case of using the photoreceptor of the present invention as a wet developing means using a liquid developer in which a toner is dispersed in a hydrocarbon solvent.

The protective layer is expected to improve rubbing resistance of a photoreceptor and also to improve the solvent resistance in a wet developing means.

On the other hand, it is found from the results of Comparative Example 1 that the photoreceptor provided with a charge generation layer having no metal oxide microparticle fails to secure generation of sufficient charges and to attain stability.

Further, it is found from the results of Comparative Example 2 that when the photoreceptor of the present invention is used in the case of using a semiconductor laser having a center oscillation wavelength of 780 nm as the image exposure light source, the level of formation of a high-quality image is clearly lower than those of Examples.

What is claimed is:

1. After the word "nm" and before the period, insert the limitation "wherein the oxotitanylphthalocyanine is an unsubstituted oxotitanylphthalocyanine having a specified crystal type which has a maximum diffraction peak at a bragg angle (2θ±0.2°) of 9.4° or 9.7° in an X-ray diffraction spectrum and has diffraction peaks at bragg angles of, at least, 7.3°, 9.4°, 9.7° and 27.3°".

2. The electrophotographic photoreceptor of claim 1, wherein the metal oxide microparticles are titanium oxide or zinc oxide.

3. The electrophotographic photoreceptor of claim 1, wherein the metal oxide microparticles have a particle diameter of a range from 5 to 100 nm.

4. The electrophotographic photoreceptor of claim 1, wherein the charge generation material is contained in the charge generation layer by a ratio of 30 to 90% by weight, and the metal oxide microparticles are contained by a ratio of 1 to 100% by weight based on the charge generation material.

5. The electrophotographic photoreceptor of claim 1, wherein the charge transport layer contains inorganic filler particles and the inorganic fillers are contained in the charge transport layer in such a dispersed state that the following equation (1) is satisfied;

$$1.0\times10^{-3}\leqq(df\times b^3/(dm\times a^3)\leqq2.5\times10^{-2} \quad (1)$$

wherein a is an average distance between fillers (nm), b is an average particle diameter of fillers (nm), df is a density of filler particles (g/cm$^3$) and dm is an average density (g/cm$^3$) of a solid in the charge transfer layer.

6. The electrophotographic photoreceptor of claim 5, wherein the inorganic filler particles are silicon oxide.

7. The electrophotographic photoreceptor of claim 5, wherein the inorganic filler particles are a particle diameter of a range from 5 to 100 nm.

8. The electrophotographic photoreceptor of claim 1, wherein the electrophotographic photoreceptor has a protective layer on a surface of the charge transport layer.

9. An image information device comprising the electrophotographic photoreceptor of claim 1, a charge means for charging the electrophotographic photoreceptor, an exposure means for exposing the charged electrophotographic photoreceptor to light corresponding to image information to form an electrostatic latent image, a developing means for developing the electrostatic latent image formed by the exposure to visualize the image, and a transfer means for transfer the image visualized by the developing to a recording medium, wherein the exposure means has a light source having a center oscillation wavelength in a wavelength range from 360 to 420 nm.

10. The image information device of claim 9, wherein the developing means is a wet developing system comprising a liquid developer in which a toner is dispersed in a hydrocarbon solvent.

* * * * *

UNITED STATES PATENT AND TRADEMARK OFFICE

CERTIFICATE OF CORRECTION

PATENT NO. : 8,076,047 B2
APPLICATION NO. : 12/408978
DATED : December 13, 2011
INVENTOR(S) : Fukushima et al.

It is certified that error appears in the above-identified patent and that said Letters Patent is hereby corrected as shown below:

Column 24, lines 27-33, Claim 1, should read -- An electrophotographic photoreceptor comprising at least a photosensitive layer formed by laminating a charge generation layer containing a charge generation material and a charge transport layer containing a charge transport material in this order, on a conductive support, wherein the charge generation layer contains an oxotitanylphthalocyanine as the charge generation material and metal oxide microparticles, and the electrophotographic photoreceptor has photosensitive properties in light source of wavelength range from 360 to 420 nm wherein the oxotitanylphthalocyanine is an unsubstituted oxotitanylphthalocyanine having a specified crystal type which has a maximum diffraction peak at a bragg angle ($2\theta \pm 0.2°$) of 9.4° or 9.7° in an X-ray diffraction spectrum and has diffraction peaks at bragg angles of, at least, 7.3°, 9.4°, 9.7° and 27.3°. --

Signed and Sealed this
Sixth Day of March, 2012

David J. Kappos

David J. Kappos
*Director of the United States Patent and Trademark Office*